US009049939B2

(12) United States Patent
Viberg

(10) Patent No.: US 9,049,939 B2
(45) Date of Patent: Jun. 9, 2015

(54) FURNITURE DEVICE

(75) Inventor: Michael Viberg, Surahammar (SE)

(73) Assignee: PASS OF SWEDEN AB (SE)

( * ) Notice: Subject to any disclaimer, the term of this patent is extended or adjusted under 35 U.S.C. 154(b) by 0 days.

(21) Appl. No.: 14/124,099

(22) PCT Filed: May 14, 2012

(86) PCT No.: PCT/EP2012/058870
§ 371 (c)(1),
(2), (4) Date: Dec. 5, 2013

(87) PCT Pub. No.: WO2012/175251
PCT Pub. Date: Dec. 27, 2012

(65) Prior Publication Data

US 2014/0116168 A1 May 1, 2014

(30) Foreign Application Priority Data

Jun. 20, 2011 (EP) ..... 11170478

(51) Int. Cl.
*A47C 17/04* (2006.01)
*A47C 13/00* (2006.01)
*A47C 20/04* (2006.01)

(52) U.S. Cl.
CPC ..... *A47C 13/00* (2013.01); *Y10T 74/18944* (2015.01); *A47C 20/041* (2013.01); *A47C 20/042* (2013.01)

(58) Field of Classification Search
CPC ..... A61G 7/018; A61G 1/04; A61G 7/002; A47C 17/1756; A47C 17/162; A47C 17/1753
USPC ..... 5/37.1, 600, 617; 74/105; 297/318, 342
See application file for complete search history.

(56) References Cited

U.S. PATENT DOCUMENTS 2,522,246 A * 9/1950 Armstrong ..... 297/318
3,216,026 A * 11/1965 Mann ..... 5/616

(Continued)

FOREIGN PATENT DOCUMENTS

DE 20308008 U1 9/2003
EP 0845231 A2 6/1998
WO 2005122841 A1 12/2005

OTHER PUBLICATIONS

International Preliminary Report on Patentability for corresponding PCT International application No. PCT/EP2012/058870 dated Dec. 23, 2013.

*Primary Examiner* — Robert G Santos
*Assistant Examiner* — Myles Throop
(74) *Attorney, Agent, or Firm* — Erickson Kernell Derusseau & Kleypas, LLC

(57) ABSTRACT

A furniture device (1) comprising a fundament (3), a support member (5) comprising a first section (7), a second section (9) and a pivoting member (15) adapted to pivot the second section between a first and a second orientation. The pivoting member comprising an arm arrangement (20, 20*a*, 20*b*) comprising a first arm (22) extending between the fundament and the second section and comprising a displaceable end (50), a second arm (40) extending between the fundament and the second section, a first pivot (24) between the first arm and the fundament and a second pivot (42) between the second arm and the fundament. The pivoting member comprises a pivoting mechanism (30) adapted to pivot the second section from the first orientation to the second orientation by inducing a displacement of the displaceable end towards the second pivot (42) while the first and the second arm act on the second section.

14 Claims, 4 Drawing Sheets

(56) References Cited

U.S. PATENT DOCUMENTS

| | | | | | |
|---|---|---|---|---|---|
| 3,913,152 | A * | 10/1975 | Quakenbush | 5/37.1 |
| 4,535,492 | A * | 8/1985 | Sebest | 5/616 |
| 4,563,784 | A * | 1/1986 | Shrock et al. | 5/37.1 |
| 4,937,900 | A * | 7/1990 | Bridges | 5/37.1 |
| 5,095,562 | A * | 3/1992 | Alexander | 5/616 |
| 7,318,625 | B2 * | 1/2008 | Roither | 297/362.11 |
| 7,441,291 | B2 * | 10/2008 | Hayes et al. | 5/618 |
| 8,387,184 | B2 * | 3/2013 | Turner et al. | 5/618 |
| 2004/0148704 | A1 * | 8/2004 | Tekulve | 5/618 |
| 2010/0325800 | A1 * | 12/2010 | Huang | 5/618 |
| 2012/0174316 | A1 * | 7/2012 | Shih | 5/600 |

* cited by examiner

FURNITURE DEVICE

FIELD OF THE INVENTION

The present invention relates to a furniture device comprising a fundament in connection to the ground and a support member on the fundament. The support member comprises a first section having a first surface parallel with a first plane and a second section having a second surface. The second section is adapted to be pivoted between a first orientation and a second orientation, wherein the second surface being parallel with the first plane in the first orientation and non-parallel with the first plane in the second orientation. The furniture device further comprises a pivoting member adapted to pivot the second section between the first and the second orientation. The pivoting member comprising at least one arm arrangement comprising an elongated first arm extending between the fundament and the second section, a first pivot between the first arm and the fundament adapted to allow a first rotation of the first arm in relation to the fundament so that the first arm acts on the second section, and a pivoting mechanism adapted to induce the first rotation.

PRIOR ART

A furniture device, such as a bed, an armchair, or other similar devices, is adapted to receive the weight or part of the weight of a being and distribute the weight from the body of the being over a part of the surface of the device. The furniture device comprises at least the first and the second section. The second section of the device is adapted to be pivoted by means of the pivoting member to different orientation in relation to the first section. In the first orientation, the furniture device is adapted to have the surface of the first section parallel with the surface of the second section, wherein the first and the second section together provide a large flat area that can be used for lying down. The second section is adapted to be pivoted to an inclination in respect to the first section, wherein the second surface is nonparallel with the first surface. In such non-parallel orientation, the second section is used for supporting the back of the being, for example when the being is in a sitting position.

The pivoting mechanism in prior art devices comprises a motor unit, such as an electric motor, that acts on a protruding part on the pivot arm in order to induce the rotation. Thereby, the protruding part is subjected to a large force, wherein the protruding part and the pivot arm require a rigidly structure in order to withstand the force from the electric motor. The requirement of a rigid structure increases the weight and the material cost of the pivot arm.

Another problem with prior art devices is that the possible rotation of the device is limited. The second section can not be inclined up to 90 degrees in relation to the first section. A further problem with prior art devices is that the motor unit requires space under the fundament of the device. Thereby, the space can not be used for storage and cleaning under the fundament is difficult.

When pivoting the second section the load on the pivoting mechanism is the highest during a first part of the pivoting movement when the second section is pivoted from the first orientation to a second orientation. On the other hand, when the second section has been pivoted a substantial degree from the first orientation the load necessary to be provided by the pivoting mechanism is less in comparison to during the first part of the pivoting movement. A problem with prior art devices is that the pivoting mechanism has to be dimensioned in order to withstand the first part of pivoting movement whereas a lower strength would be sufficient for the second part of the pivoting movement.

Yet another problem with prior art furniture devices is that a significant interaction occurs between the first and second section when the second section is pivoted. It is desired to keep the first and the second section adjacent to each other while pivoting the second section in relation to the first section, and on the same time reduce the interaction between the first and the second section.

WO2005/122841 discloses a device for pivoting a second section in relation to a first section between a first and a second orientation. The device comprises a fundament and a pivoting member. The pivoting member comprises an arm arrangement comprising a first arm (see FIGS. 2 and 3, reference number 12*a*, 12*b*), a first pivot between the first arm and the fundament and a second pivot between the first arm and the second section. The device further comprises a drive unit adapted to induce a rotation of the arm arrangement so that the arm arrangement acts on the second section. The drive unit acts by means of an electric motor on a protruding part (see FIG. 3, reference number 13) of the arm arrangement, wherein the second section is pivoted between the first and the second orientation. The device has the above described problems and disadvantages.

OBJECTS AND SUMMARY OF THE INVENTION

The object of the present invention is an improved furniture device. A first object of the invention is a device that requires a less rigid arm arrangement in comparison to prior art. A second object of the invention is a device, which comprises a pivoting mechanism that requires less space under the fundament in comparison to prior art. A third object of the invention is a device that enables the second section to be pivoted between the first and the second orientation with reduced or no interaction between the first and the second section. A fourth object of the invention is to provide a device enables the second section to be pivoted with higher strength at a first part of the pivoting movement in comparison to a second part of the pivoting movement.

These objects are achieved by a furniture device according to claim 1. The furniture device is characterized in that the first arm comprises a displaceable end comprising the first pivot and the arm arrangement further comprises an elongated second arm extending between the fundament and the second section, a second pivot between the second arm and the fundament adapted to allow a second rotation of the second arm in relation to the fundament so that the second arm acts on the second section, the first pivot is arranged closer to the first section than the second pivot, wherein the pivoting mechanism is adapted to pivot the second section from the first orientation to the second orientation by inducing a displacement of the displaceable end towards the second pivot while the first arm and the second arm act on the second section and to pivot the second section from the second orientation to the first orientation by inducing a displacement of the displaceable end away from the second pivot while the first arm and the second arm act on the second section.

The pivot mechanism is adapted to induce the displacement of the displaceable end. When the second section is pivoted from the first orientation to the second orientation, the displaceable end is displaced towards the second pivot. Thereby, the distance between the displaceable end and the second pivot is reduced, wherein the first arm and the second arm are rotated towards the second section in order to adjust to the reduced distance between the displaceable end and the second pivot while the arm arrangement acts on the second section and pivots the second section from the first orientation to the second orientation. The first rotation and the second rotation are arranged in opposite directions.

The arm arrangement is adapted to pivot the second section between the first and the second orientation without applying pressure on a protruding part, which is necessary in prior art devices. Instead, the displaceable end of the second arm is adapted to be displaced, wherein both the first arm and the second arm act on the second section. Accordingly, the pivot arm may be made of a less rigid structure than in prior art devices. Thereby, the material cost for the pivot arm is reduced. Furthermore, the weight of the device is reduced.

According to one embodiment of the invention, the arm arrangement comprises a third pivot between the second arm and the second section adapted to allow a third rotation of the second arm in relation to the second section. Thereby, the second arm extends from the second pivot at the fundament to the third pivot at the second section. Accordingly, the second arm is adapted to adjust to the displacement of the displaceable end.

According to one embodiment of the invention, the displaceable end is adapted to engage in and be guided by a guide member. The guide member guides the displacement of the displaceable end towards and away from the second pivot. The guide member is for example a groove, a rail, a notch, etcetera. The guide member is adapted to assure that the displaceable end is displaced towards and away from the second pivot.

According to one embodiment of the invention, the arm arrangement further comprises an elongated third arm extending from the second arm to the second section, a fourth pivot between the third arm and the second arm adapted to allow a fourth rotation of the third arm in relation to the second arm, and a further displaceable end, wherein the pivoting mechanism is adapted to pivot the second section from the first orientation to the second orientation by acting on the third arm so that the further displaceable end is displaced on the second section towards the first section while the further displaceable end acts on the second section and to pivot the second section from the second orientation to the first orientation by acting on the third arm so that the further displaceable end is displaced on the second section away from the first section while the further displaceable end acts on the second section.

The pivot mechanism is adapted to act on the third arm so that the further displaceable end is displaced towards or away from the first section. By means of the displacement of the further displaceable end, the fourth rotation of the fourth pivot is induces, wherein the further displaceable end pushes the second section away from the fundament and thereby reduces the distance between the first pivot of the first arm and the second pivot of the second arm. In order to adjust to the reduced distance between the first pivot and the second pivot, the displaceable end is displaced towards the second pivot while the first rotation of the first arm and the second rotation of the second arm are induced.

The pivoting mechanism is adapted to act on the third arm so that the further displaceable end is displaced on the second section towards or away from the first section. Thereby, the pivoting mechanism can be arranged so that it does not require space under the fundament, wherein the space under the fundament may be used for other purposes such as storage. Furthermore, without obstacle of the pivoting mechanism, cleaning under the fundament is facilitated.

According to one embodiment of the invention, the fourth pivot is arranged at a location between the second pivot and an end of the second arm connected to the second section. Thereby, the third arm extends from the second arm to the second section, wherein the third arm acts on the second section.

According to one embodiment of the invention, the further displaceable end and the displaceable end are displaced simultaneously by means of that the pivoting mechanism acting on the third arm. Thereby, the pivoting mechanism may be arranged at the second section so that the pivoting mechanism does not require space under the fundament.

According to one embodiment of the invention, the first arm acts on a first part of the second section and the third arm acts on a second part of the second section, the first part being arranged closer to the first section than the second part. By means of that the first and third arm acts on different parts of the second section, the stability of the pivoting movement of the second section is improved. Also the stability when the second section is static in the second orientation is improved.

According to one embodiment of the invention, the second section comprises a lower surface directed towards the arm arrangement, which lower surface comprises a displacement surface that is adapted to facilitate the displacement of the further displaceable end. Preferably, the displacement surface is adapted to facilitate a gliding displacement of the further displaceable end. The lower surface is directed essentially in the opposite direction of the second surface.

According to one embodiment of the invention, the second section comprises a further guide member protruding away from the lower surface of the second section and comprising said displacement surface, wherein the further guide member is adapted to guide the displacement of the further displaceable end. The further guide member is adapted to control the response of the displacement of the further displaceable end to the pivoting movement of the second section.

According to one embodiment of the invention, the further guide member is wedge shaped.

According to one embodiment of the invention, the third arm comprise an elongated first arm part and an elongated second arm part, wherein the first arm part is closer to the fourth pivot than the second arm part, and a fifth pivot between the first arm part and the second arm part adapted to allow a fifth rotation of the second arm part in relation to the first arm part, wherein the pivoting mechanism is adapted to act on an outer part of the third arm, which outer part is located at a greater distance from the fourth pivot than the fifth pivot.

By means of the arrangement of the third arm comprising the first arm part and the second arm part, the pivoting movement of the second section is divided into a first part and a second part. The first part of the pivoting movement relates to pivoting the second section between the first and the second orientation and the second part of the pivoting movement relates to pivoting the second section between the second orientation and a third orientation, in which third orientation the second surface is arranged in a higher inclination to the first plane in comparison to in the second orientation.

The length between the further displaceable end and the fifth pivot is shorter than the length between the further displaceable end and the fourth pivot. On the other hand, during pivoting the second section between the first and the second orientation, the fifth rotation is engaged whereas the fourth rotation is disengaged or essentially disengaged. During pivoting the second section between the second and the third orientation, the fourth rotation is engaged whereas the fifth rotation is disengaged or essentially disengaged.

When pivoting the second section between the first and the second orientation, the pivoting movement involves a first lever in respect to the fifth pivot. When pivoting the second section between the second and the third orientation, the second part of the pivoting movement involves a second lever in respect to the fourth pivot.

The pivoting movement of the second section between the first and the second orientation can be regarded as a first gear providing high strength to pivot the second section from the first orientation but with low speed of the pivoting movement for a certain rate of displacement of the further displaceable end. The pivoting movement of the second section between the second and the third orientation can be regarded as a second gear providing less strength but higher speed in comparison to the pivoting movement between the first and the second orientation for the certain rate of displacement of the further displaceable end.

The pivoting movement of the second section between the first and the second orientation is heavier than pivoting between the second and the third orientation, because between the first and the second orientation a larger portion of the weight of the second section has to be lifted in order to pivot the second section in comparison to when pivoting the second section between the second and the third orientation. Accordingly, the pivoting member is arranged so that higher strength is provided when pivoting the second section between the first and the second orientation in comparison to when pivoting the second section between the second and the third orientation, and higher speed is provided when pivoting the second section between the second and the third orientation in comparison to when pivoting the second section between the first and the second orientation. Thereby, the component of the pivoting member may be modify so that a less rigid structure is used, wherein the weight, the strength and the material cost is reduced in comparison to prior art.

According to one embodiment of the invention, the first arm part extends along a first longitudinal axis and the second arm part extends along a second longitudinal axis, and one of the first arm part and the second arm part comprises a stop member adapted to stop the fifth rotation at a first inclination between the first longitudinal axis and the second longitudinal axis. The stop member is adapted to stop the fifth rotation of second arm part in relation to the first arm part. Accordingly, the stop member defines the extent of the pivoting movement of the second section from the first to the second orientation.

According to one embodiment of the invention, the pivoting member comprises a support element in connection to the fundament, which support element is adapted to support the first arm part during at least a part of the pivoting movement of the second section between the first and the second orientation. By means of the support element the first arm part is supported when pivoting the second section between the first orientation and the second orientation.

According to one embodiment of the invention, the pivoting mechanism is adapted, when the second section is pivoted from the first orientation to the second orientation, to act on the third arm and thereby displacing the further displaceable end towards the first section while the further displaceable end acts on the second section so that the first rotation, the second rotation, the third rotation and the fifth rotation are induced while the first arm part is maintained in a static orientation or essentially static in relation to the second arm.

According to one embodiment of the invention, the pivoting mechanism is adapted, when the second section is pivoted from the second orientation to the first orientation, to act on the third arm and thereby displacing the further displaceable end away from the first section while the further displaceable end acts on the second section so that the first rotation, the second rotation, the third rotation and the fifth rotation are induced while the first arm part is maintained in a static orientation or essentially static in relation to the second arm.

When pivoting the second section between the first and the second orientation, the first rotation, the second rotation, the third rotation and the fifth rotation are involved that provide the high strength in comparison to pivoting the second section between the second and the third orientation. However, when pivoting the second section between the first and the second orientation, the fourth rotation is essentially not involved.

According to one embodiment of the invention, the first arm part is maintained in a static position on the support element when pivoting the second section between the first and the second orientation.

According to one embodiment of the invention, the second section is adapted to be pivoted between the second orientation and a third orientation, wherein the pivoting mechanism is adapted, when the second section is pivoted from the second orientation to the third orientation, to act on the third arm and thereby displacing the further displaceable end towards the first section while the further displaceable end acts on the second section so that the first rotation, the second rotation, the third rotation and the fourth rotation are induced while the fifth rotation is prevented by the stop member.

According to one embodiment of the invention, wherein the pivoting mechanism is adapted, when the second section is pivoted from the third orientation to the second orientation, to act on the third arm and thereby displacing the further displaceable end away from the first section while the further displaceable end acts on the second section so that the first rotation, the second rotation, the third rotation, the fourth rotation are induced while the fifth rotation is prevented by the stop member.

When pivoting the second section between the second and the third orientation, the first rotation, the second rotation, the third rotation, the fourth rotation are involved that provide the high speed in comparison to pivoting the second section between the first and the second orientation. However, when pivoting the second section between the second and the third orientation, the fifth rotation is essentially not involved, wherein the orientation of the second arm part is maintained essentially static in relation to the first arm part.

According to one embodiment of the invention, in the second orientation the second section is inclined at a first angle with the first plane and in the third orientation the second section is inclined at a second angle with the first plane, the second angle being higher than the first angle.

According to one embodiment of the invention, the pivoting mechanism comprises a drive unit comprising an elongated driving element and a displacement member adapted to be displaced along the driving element and connected to the further displaceable end. By means of the elongated driving element and the displacement member the further displaceable end is displaced towards or away from the first section.

According to one embodiment of the invention, the drive unit comprises a drive motor adapted to act on the driving element so that the displacement member is displaced along the driving element.

According to one embodiment of the invention, the furniture device comprises a link arm extending from a sixth pivot between the link arm and the connection element to a seventh pivot between the link arm and the displacement member. The link arm enables the further displaceable end to be pivoted on the further guide member in that the link arm is adapted to allow the second section to be pivoted independently from the pivoting movement provided by the pivoting member. By means of the link arm it is further assured that a person is not pinched between the second section and the fundament when pivoting the second section.

According to one embodiment of the invention, the drive motor is adapted to generate a force that pulls the third arm towards the first section when the second section is pivoted from the first orientation to the second orientation and pushes the third arm away from the second section when the second section is pivoted from the second orientation to the first orientation.

According to one embodiment of the invention, the device comprises the arm arrangement and a further arm arrangement, each arm arrangement having the same configuration and being arranged at opposite sides of the fundament, and a connection element connecting the arm arrangement and the further arm arrangement together. By means of the arm arrangement and the further arm arrangement the stability of the pivoting movement is improved.

According to one embodiment of the invention, the pivoting mechanism acts on the connection element so that the further displaceable end is displaced towards or away from the first section. The connection element assures that the arm arrangement and the further arm arrangement acts synchronized on the second section when the second section is pivoted.

According to one embodiment of the invention, the device comprises a gap between the first section and the second section separating the second section from the first section.

According to one embodiment of the invention, the second arm is arranged fixed between the fundament and the second section by means of the second pivot and the third pivot.

According to one embodiment of the invention, an opposite end to the displaceable end of the first arm is attached to the second section.

According to one embodiment of the invention, the second section is adapted to be pivoted into any orientation between the first, the second and the third orientation.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

A furniture device 1 is now to be described with reference to FIGS. 1*a*-1*c* and 2*a*-2*e*. The structure of the furniture device 1 will in particular be explained with reference to FIG. 1*a*-1*c* and the pivoting movement with reference to FIG. 2*a*-2*e*.

Figure 1A:
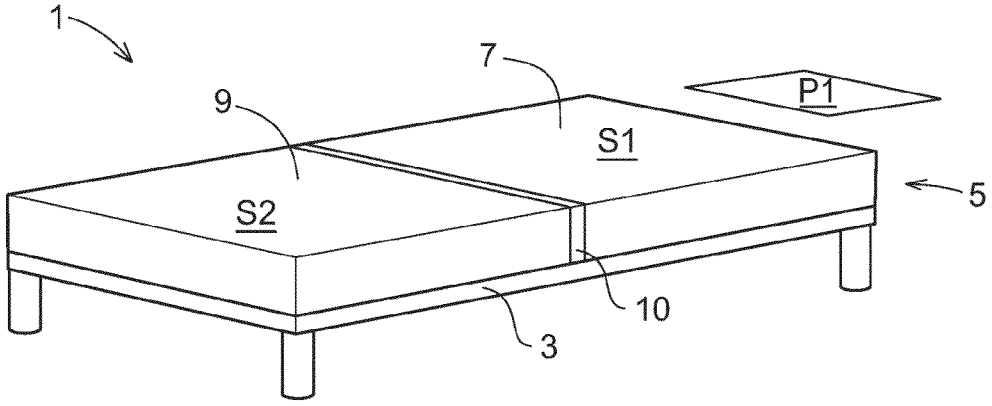
FIG. 1*a* shows a general overview of a furniture device according to an embodiment of the invention.

FIG. 1*a* shows a general overview of the furniture device 1 according to an embodiment of the invention. The furniture device 1 comprises a fundament 3 in connection to the ground by means of support legs. The device 1 comprises a support member 5 on the fundament 3. The support member 5 comprises a first section 7 comprising a first surface S1 parallel with a first plane P1 and a second section 9 comprising a second surface S2. The first section 7 and the second section 9 are separated by a gap 10.

The second section 9 is adapted to be pivoted between a first, a second and a third orientation. In the first orientation the second surface S2 of the second section 9 is parallel with the first plane P1 and in the second and the third orientation the second surface S2 is non-parallel with the first plane P1.

Figure 1B:
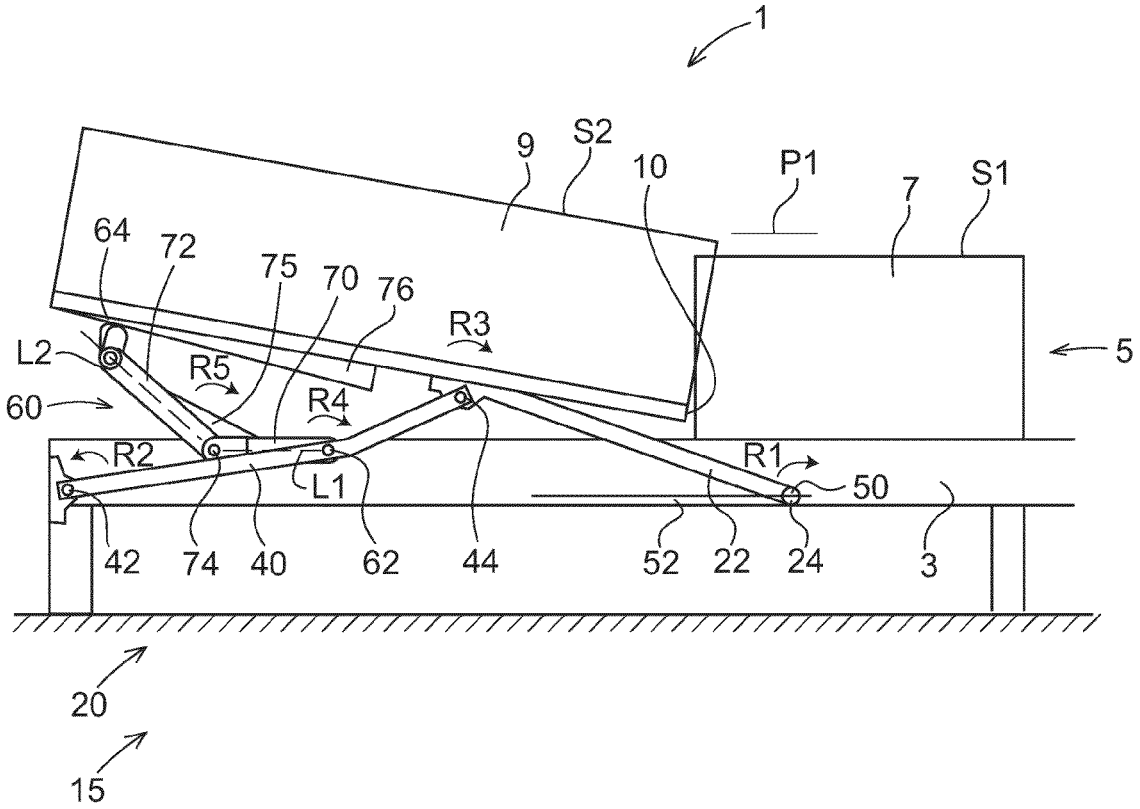
FIG. 1*b* shows the furniture device in FIG. 1*a* from a side view.

FIG. 1*b* shows the device 1 seen from a side view. The furniture device 1 comprises a pivoting member 15 adapted to pivot the second section 9 between the first, the second and the third orientation. The pivoting member 15 comprises an arm arrangement 20 comprising an elongated first arm 22 that extends between the fundament 3 and the second section 9, a first pivot 24 between the first arm 22 and the fundament 3 adapted to allow a first rotation R1 of the first arm 22 in relation to the fundament 3.

The arm arrangement 20 further comprises an elongated second arm 40 extending between the fundament 3 and the second section 9. The arm arrangement 20 further comprises a second pivot 42 between the second arm 40 and the fundament 3. The second pivot 42 is adapted to allow a second rotation R2 of the second arm 40 in relation to the fundament 3. The arm arrangement 20 further comprises a third pivot 44 between the second arm 40 and the second section 9. The third pivot 44 is adapted to allow a third rotation R3 of the second arm 40 in relation to the second section 9.

Figure 1C:
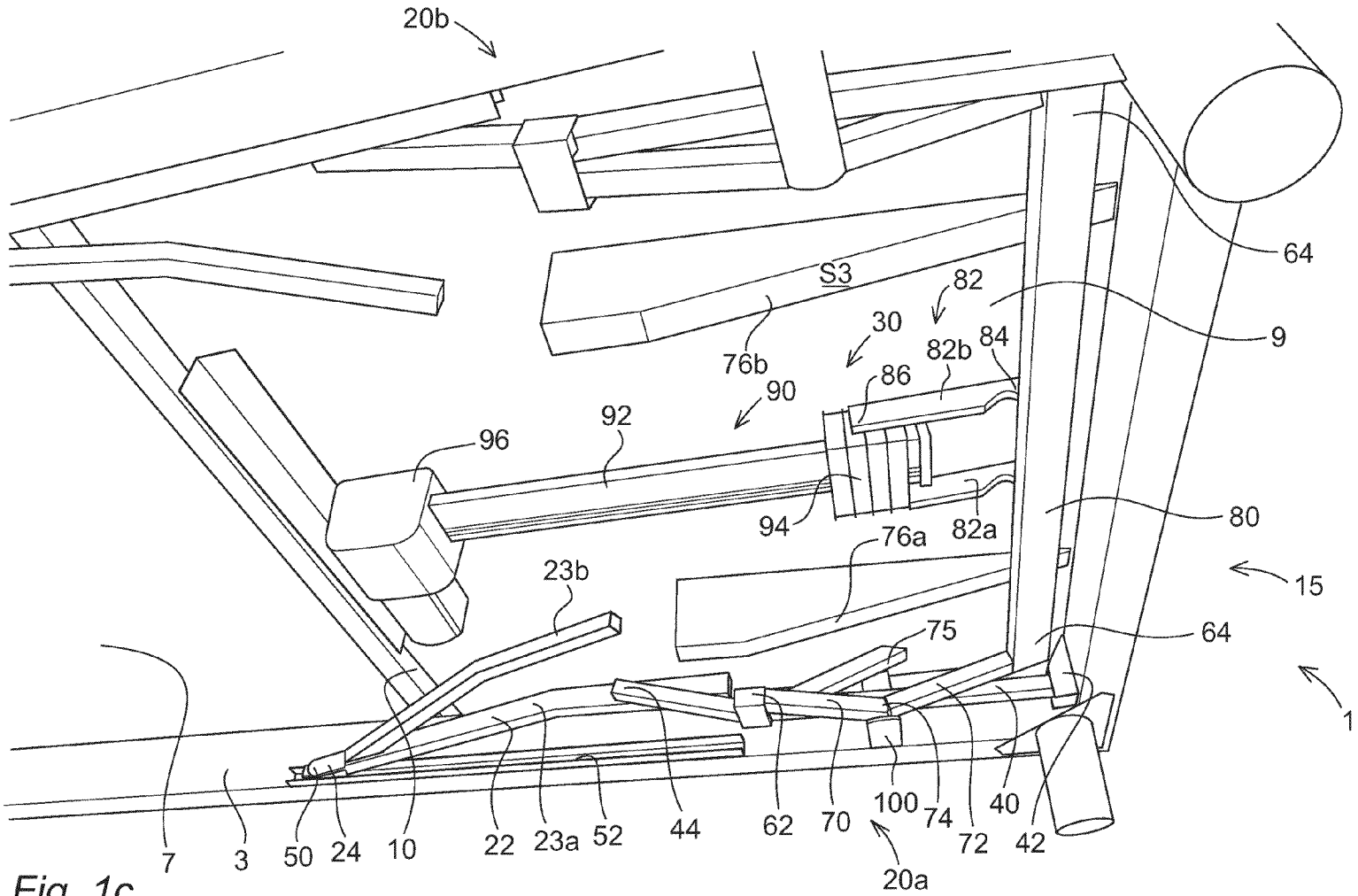
FIG. 1*c* shows a pivoting mechanism of the furniture device of FIG. 1*a* in a perspective view from the ground.

The pivoting member 15 further comprises a pivoting mechanism 30, see FIG. 1*c*, adapted to generate a force that pivots the second section 9 between the first, the second and the third orientation.

The arm arrangement 20 is configured so that the first pivot 24 is arranged closer to the first section 7 than the second pivot 42. The first pivot 24 is arranged closer to the first section 7 than the third pivot 44. The third pivot 44 is arranged closer to the first section 7 than the second pivot 42.

The first arm 22 further comprises a displaceable end 50 comprising the first pivot 24 and the pivoting member 15 comprises a guide member 52 adapted to guide the displacement of the displaceable end 50 in a direction towards or away from the second pivot 42. The guide member 52 is for example a groove, a rail, a notch, etcetera that guides the displacement of the displaceable end 50 towards and away from the second pivot 42.

The first arm 22 extends from the displaceable end 50 to the second section 9, where and end part of the first arm 22 is attached to the lower side of the second section 9. In order to assure that the displaceable end 50 is maintained in contact with the guide member 52, the first arm 22 comprises a first arm portion 23*a* and a second arm portion 23*b* that are attached to different parts at the second section 9. The second arm portion 23*b* is attached further from the side of the device 1 in comparison to the first arm portion 23*a* in order to assure that the displaceable end 50 is maintained guided by the guide member 52.

The arm arrangement 20 further comprises an elongated third arm 60 extending from the second arm 40 to the second section 9, and a fourth pivot 62 between the third arm 60 and the second arm 40. The fourth pivot 62 is adapted to allow a fourth rotation R4 of the third arm 60 in relation to the second arm 40.

The third arm 60 further comprises a further displaceable end 64 that is adapted to be displaced on a lower surface of a second section 9, which lower surface is directed towards the arm arrangement 15 and the fundament 3.

The third arm 60 comprises an elongated first arm part 70 and an elongated second arm part 72 that are connected to each other by means of a fifth pivot 74 between the first arm part 70 and the second arm part 72. The first arm part 70 is connected to the fourth pivot 62 than the second arm part 72. The fifth pivot 74 is adapted to allow a fifth rotation R5 of the second arm part 72 in relation to the first arm part 70.

The first arm part 70 extends along a first longitudinal axis L1 and a second arm part extends along a second longitudinal axis L2. The third arm 60 further comprises a stop member 75 arranged on the first arm part 70. The stop member 75 is adapted to stop the fifth rotation R5 at a first inclination between the first longitudinal axis L1 and the second longitudinal axis L2.

The second section 9 comprises a further guide member 76 adapted to guide the displacement of the further displaceable end 64 on the second section 9. The further guide member 76 comprises a wedge formed element that protrudes away from the lower surface of the second section 9. The further displaceable end 64 is adapted to be displaced on the further guide member 76 by means of a gliding movement.

The further guide member 76 comprises a displacement surface S3 that is adapted to facilitate the displacement of the further displaceable end 64. The displacement surface S3 is directed towards the arm arrangement 20 and the fundament 3. Preferably, the displacement surface S3 provides a low friction coefficient that enables the further displaceable end 64 to be displaced on the displacement surface S3.

FIG. 1*c* shows the second section 9 including the pivoting member 15 as seen from the ground. The pivoting member 15 comprises two arm arrangements, an arm arrangement 20*a* configured at a first side of the second section 9 and a further arm arrangement 20*b* configured at a second side of the second section 9. The arm arrangement 20*a* and the further arm arrangement 20*b* comprise the same structural components.

The arm arrangement 20 *a* and the further arm arrangement 20*b* are connected by means of a connection element 80 that extends between the respective further displaceable end 64 of the arm arrangement and the further arm arrangement 20*b*.

The second section 9 comprises two further guide members 76*a*, 76*b* separated apart. The connection element 80 is adapted to simultaneously be displaced on the two further guide members 76*a*, 76*b* by means of a gliding movement. By means of the two further guide members 76*a*, 76*b*, the stability of the pivoting movement of the second section 9 is improved.

The furniture device 1 comprises a link arm 82 comprising two parallel arms 82*a*, 82*b* arranged on opposite sides of the displacement member 94. The link arm 82 extends from a sixth pivot 84 between the link arm 82 and the connection element 80 to a seventh pivot 86 between the link arm 82 and the displacement member 94. By means of the link arm 82, the further displaceable end 64 is enabled to be pivoted on the further guide members 76*a*, 76*b*, which further guide members 76*a*, 76*b* protrudes away from the lower side of the second section 9. Furthermore, it is assured that a person is not pinched between the second section 9 and the fundament 3 when pivoting the second section 9.

The pivoting mechanism 30 comprises a single drive unit 90. The pivoting mechanism 30 is connected to the lower side of the second section 9. Thereby, the pivoting mechanism 30 does not require space under the fundament 3.

The drive unit 90 comprises an elongated driving element 92 and a displacement member 94 adapted to be displaced along the driving element 92. The drive unit 90 further comprises a drive motor 96 adapted to act on the driving element 92 so that the displacement member 94 is displaced along the driving element 92.

Preferably, the drive motor is an electric motor that is adapted to rotate the driving element 92 that comprises a threaded axis. The displacement member 94 is for example connected to a threaded nut that is displaced along the driving element 92 when the threaded axis is rotated.

The pivoting mechanism 30 is adapted to pivot the second section 9 between the first, the second and the third orientation by acting on the connection element 80 with a force so that the connection element 80 and thereby the further displaceable ends 64 of the respective arm arrangement 20*a* and the further arm arrangement 20*b* are displaced on the further guide members 76*a*, 76*b*. Thereby, the first arm 22, the second arm 40 and the third arm 60 act on the second section 9 so that the pivoting movement of the second section 9 is induced.

The pivoting mechanism 30 is adapted to pivot the second section 9 from the first orientation to the second orientation by acting on the connection element 80 so that the further displaceable end 64 is displaced towards the first section 7 while the further displaceable end 64 acts on the second section 9 and while simultaneously the displaceable end 50 is displaced towards the second pivot 42.

In the same manner, the pivoting mechanism 30 is adapted to pivot the second section 9 from the second orientation to the first orientation by acting on the connection element 80 so that the further displaceable end 64 is displaced in a direction away from the first section 7 on the lower surface of a second section 9 while the further displaceable end 64 acts on the second section 9 and while simultaneously the displaceable end 50 is displaced away from the second pivot 42.

Figure 2A:
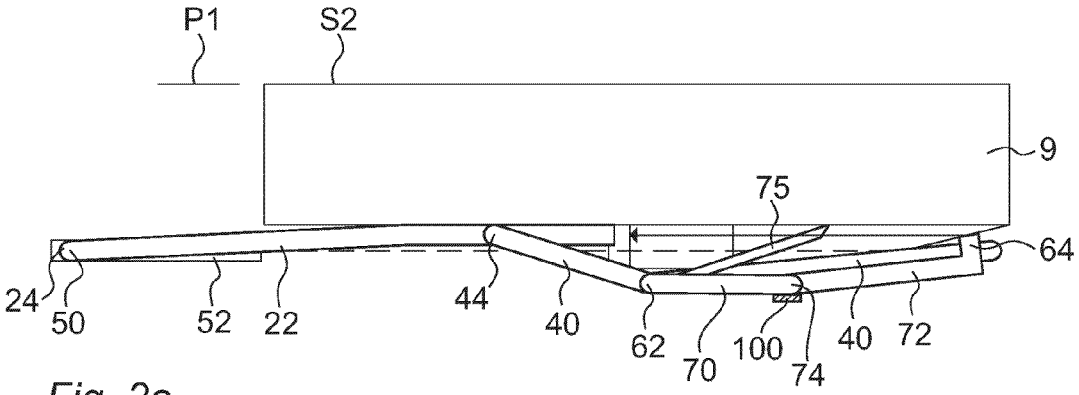
FIG. 2*a* shows a side view of the furniture device comprising a second section, where the second section is arranged in a first orientation.

In FIG. 2*a*-2*e* the pivoting movement of the second section 9 will be explained. Starting from the first orientation as seen in FIG. 2*a*, the pivoting movement is initiated by means of the pivoting mechanism 30 displacing the further displaceable end 64 on the further guide member 76 of the second section 9 in a direction towards the first section 7, which displacement lifts the second section 9 away from the fundament 3.

The lifting of the second section 9 away from the fundament 3 results in that the distance between the displaceable end 50 and the second pivot 42 is reduced, wherein on the arm arrangement 20 in order to adjust to this reduced distance respond with the first rotation R1, the second rotation R2, the third rotation R3 and the fifth rotation R5, while the displaceable end 50 is displaced towards the second pivot 42. Accordingly, the displacement of the further displaceable end 76 induces a change in the orientation of the individual arms of the arm arrangement 20. This change results in that the first arm 22, the second arm 40 and the third arm 60 acting on the second section 9 so that the second section 9 is pivoted.

According to one embodiment of the invention, the pivoting member 15 comprises a support element 100 in connection to the fundament 3. Support element 100 is adapted to support the first arm part 70 during at least a part of the pivoting movement of the second section 9 between the first and the second orientation. By means of the support element 100 the first arm part 70 is supported when pivoting the second section 9 between the first orientation and the second orientation.

The pivoting movement of the second section 9 from the first orientation in FIG. 2*a* to the second orientation in FIG.

Figure 2B:
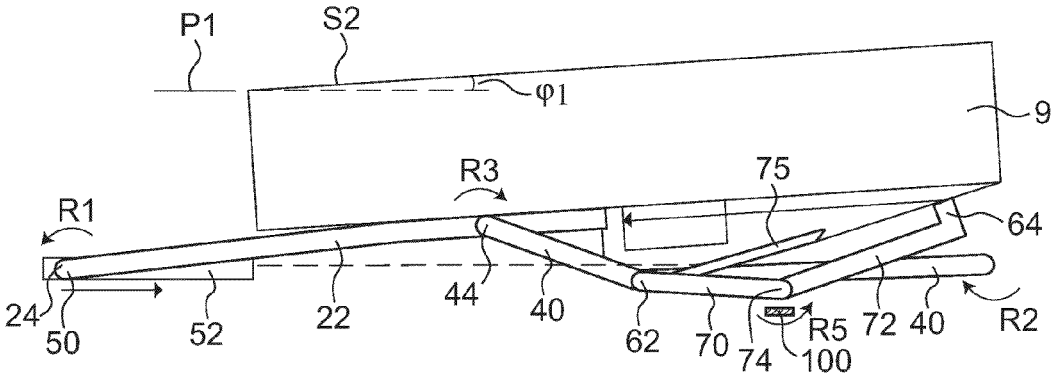
FIG. 2*b* shows a side view of the furniture device, where the second section is arranged between the first orientation and a second orientation.

2*c*, where the second section 9 is oriented so that the inclination between the second surface S2 and the first plane P1 has an angle ϕ2, involves the first rotation R1, the second rotation R2, the third rotation R3 and the fifth rotation R5, while the first arm part 70 is static or essentially static and thus not involving the fourth rotation R4. FIG. 2*b* discloses an intermediate orientation of the second section 9 between the first and the second orientation where the second section 9 is oriented so that the inclination between the second surface S2 and the first plane P1 has an angle ϕ1.

Figure 2C:
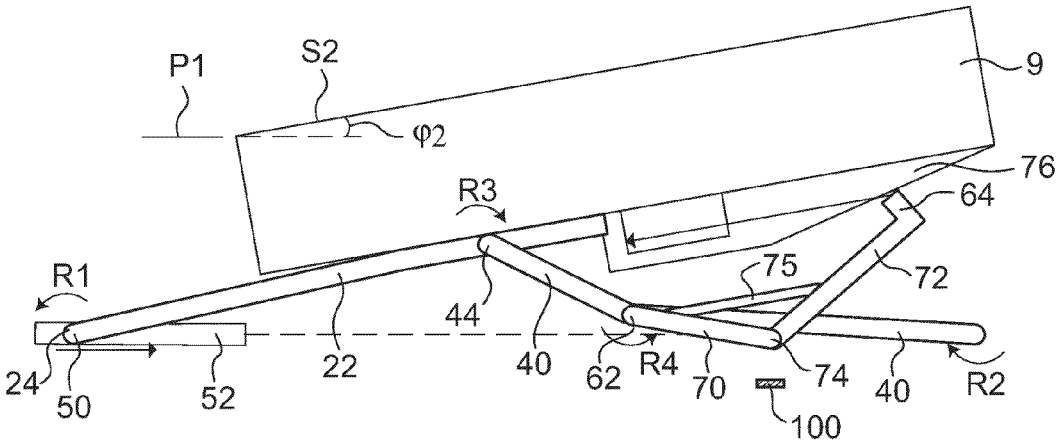
FIG. 2*c* shows a side view of the furniture device, where the second section is arranged in the second orientation.

Starting from the second orientation as seen in FIG. 2*c*, where the second section 9 is oriented so that the inclination between the second surface S2 and the first plane P1 has an angle ϕ2, the pivoting movement is initiated by means of the pivoting mechanism 30 displacing the further displaceable end 64 on the further guide member 76 of the second section 9 in a direction towards the first section 7, which displacement lifts the second section 9 away from the fundament 3. In the second orientation the stop member 75 has stopped the fifth rotation R5 but the fourth rotation R4 has essentially not been initiated, wherein the orientation of the first arm part 70 in relation to the second arm 40 is essentially the same in the first orientation and the second orientation.

Figure 2D:
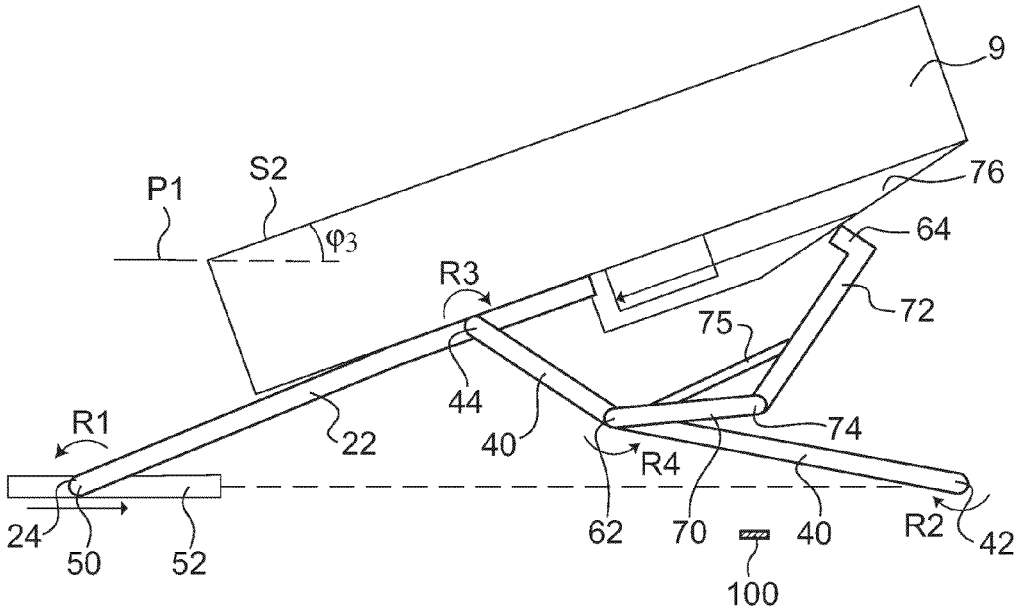
FIG. 2*d* shows a side view of the furniture device, where the second section is arranged between the second orientation and a third orientation.
Figure 2E:
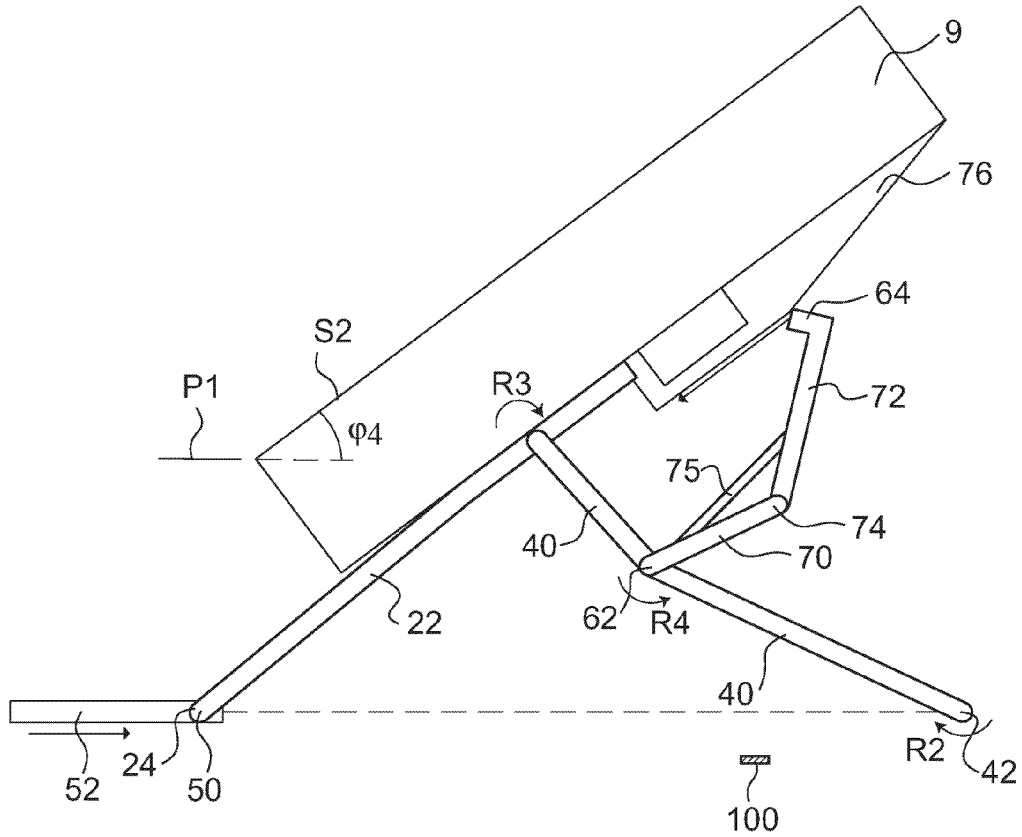
FIG. 2*e* shows a side view of the furniture device, where the second section is arranged in the third orientation.

The pivoting movement of the second section 9 from the second orientation in FIG. 2*d* to the third orientation in FIG. 2*e*, where the second section 9 is oriented so that the inclination between the second surface S2 and the first plane P1 has an angle ϕ4, involves the first rotation R1, the second rotation R2, the third rotation R3 and the fourth rotation R4 while any further fifth rotation R5 is prevented by the stop member 75. FIG. 2*d* discloses an intermediate orientation of the second section 9 between the second and the third orientation where the second section 9 is oriented so that the inclination between the second surface S2 and the first plane P1 has an angle ϕ3.

The first part of the pivoting movement when the second section 9 is pivoted between the first and the second orientation provides a high strength in that the length of the third arm 60 that is involved in the pivoting movement, i.e. the second arm part 72 by the fifth rotation R5, is shorter than the length involved in the pivoting movement between the second and the third orientation where the whole third arm 60 is involved by means of the fourth rotation R4. Thereby, the first part of the pivoting movement can be regarded as a "first gear" providing higher strength but lower speed to induce the change in orientation of the individual arms of the arm arrangement 20 that induces the pivoting movement of the second section 9 in comparison to during the second part of the pivoting movement. The second part of the pivoting movement can be regarded as a "second gear" providing higher speed but lower strength to induce the change in orientation of the individual arms of the arm arrangement 20 that induces the pivoting movement of the second section 9 in comparison to during the first part of the pivoting movement.

The present invention is not limited to the embodiments disclosed but may be varied and modified within the scope of the following claims.

It shall be understood that FIG. 1*a*-1*c* and FIG. 2*a*-2*e* are schematic representation of the invention for the purpose of explanation. The invention is not limited to the inclination on the second section 9 as shown in FIG. 2*e*. The dimensions of the pivoting member 15 may be modified in order to enable the second section 9 to be pivoted so that the inclination between the second surface S2 and the first plane P1 has an angle ϕ4 is up to 90°.

What is claimed is:

1. A furniture device comprising:

a fundament in connection to the ground, a support member on the fundament, the support member comprising a first section having a first surface parallel with a first plane and a second section having a second surface, wherein the second section is adapted to be pivoted between a first orientation and a second orientation, the second surface being parallel with the first plane in the first orientation and non-parallel with the first plane in the second orientation, a pivoting member adapted to pivot the second section between the first and the second orientation, the pivoting member comprising at least one arm arrangement comprising an elongated first arm extending between the fundament and the second section, a first pivot between the first arm and the fundament adapted to allow a first rotation of the first arm in relation to the fundament so that the first arm acts on the second section, and a pivoting mechanism adapted to induce the first rotation, wherein the first arm comprises a displaceable end comprising the first pivot and the arm arrangement further comprises an elongated second arm extending between the fundament and the second section, a second pivot between the second arm and the fundament adapted to allow a second rotation of the second arm in relation to the fundament so that the second arm acts on the second section, the first pivot is arranged closer to the first section than the second pivot, wherein the pivoting mechanism is adapted to pivot the second section from the first orientation to the second orientation by inducing a displacement of the displaceable end towards the second pivot while the first arm and the second arm act on the second section and to pivot the second section from the second orientation to the first orientation by inducing a displacement of the displaceable end away from the second pivot while the first arm and the second arm act on the second section, and wherein the arm arrangement further comprises an elongated third arm extending from the second arm to the second section, a fourth pivot between the third arm and the second arm adapted to allow a fourth rotation of the third arm in relation to the second arm, and a further displaceable end on the third arm opposite the fourth pivot, wherein the pivoting mechanism is adapted to pivot the second section from the first orientation to the second orientation by acting on the third arm so that the further displaceable end glides relative to the second section towards the first section while the further displaceable end acts on the second section and to pivot the second section from the second orientation to the first orientation by acting on the third arm so that the further displaceable end glides relative to the second section away from the first section while the further displaceable end acts on the second section.

2. A furniture device according to claim 1, wherein the arm arrangement comprises a third pivot between the second arm and the second section adapted to allow a third rotation of the second arm in relation to the second section.

3. A furniture device according to claim 1, wherein the displaceable end is adapted to engage in and be guided by a guide member.

4. A furniture device according to claim 1, wherein the first arm acts on a first part of the second section and the third arm acts on a second part of the second section, the first part being arranged closer to the first section than the second part.

5. A furniture device according to claim 1, wherein the second section comprises a lower surface directed towards the arm arrangement, which lower surface comprises a displacement surface that is adapted to facilitate gliding of the further displaceable end relative to the second section.

6. A furniture device according to claim 5, wherein the second section comprises a further guide member protruding away from the lower surface of the second section and comprising said displacement surface, wherein the further guide member is adapted to guide the gliding of the further displaceable end relative to the second section.

7. A furniture device according to claim 2, wherein the third arm comprise an elongated first arm part and an elongated second arm part, wherein the first arm part is closer to the fourth pivot than the second arm part, and a fifth pivot between the first arm part and the second arm part adapted to allow a fifth rotation of the second arm part in relation to the first arm part, wherein the pivoting mechanism is adapted to act on an outer part of the third arm which outer part is located at a greater distance from the fourth pivot than the fifth pivot.

8. A furniture device according to claim 7, wherein the first arm part extends along a first longitudinal axis and the second arm part extends along a second longitudinal axis, and one of the first arm part and the second arm part comprises a stop member adapted to stop the fifth rotation at a first inclination between the first longitudinal axis and the second longitudinal axis.

9. A furniture device according to claim 7, wherein the pivoting member comprises a support element in connection to the fundament, which support element is adapted to support the first arm part during at least a part of the pivoting movement of the second section between the first and the second orientation.

10. A furniture device according to claim 7, wherein the pivoting mechanism is adapted, when the second section is pivoted from the first orientation to the second orientation, to act on the third arm and thereby causing the further displaceable end to glide towards the first section while the further displaceable end acts on the second section so that the first rotation, the second rotation, the third rotation and the fifth rotation are induced while the first arm part is maintained in a static orientation in relation to the second arm.

11. A furniture device according to claim 8, wherein the second section is adapted to be pivoted between the second orientation and a third orientation, wherein the pivoting mechanism is adapted, when the second section is pivoted from the second orientation to the third orientation, to act on the third arm and thereby causing the further displaceable end to glide towards the first section while the further displaceable end acts on the second section so that the first rotation, the second rotation, the third rotation and the fourth rotation are induced while the fifth rotation is prevented by the stop member.

12. A furniture device according to claim 1, wherein the pivoting mechanism comprises a drive unit comprising an elongated driving element and a displacement member adapted to be displaced along the driving element so that the displacement member is displaced along the driving element.

13. A furniture device according to claim 1, wherein the device comprises the arm arrangement and a further arm arrangement, each arm arrangement having the same configuration and being arranged at opposite sides of the fundament, and a connection element connecting the arm arrangement and the further arm arrangement together.

14. A furniture device according to claim 13, wherein the pivoting mechanism acts on the connection element so that the further displaceable end glides towards or away from the first section.

* * * * *